US005237243A

United States Patent [19]

Chung

[11] Patent Number: 5,237,243

[45] Date of Patent: Aug. 17, 1993

[54] DIMMING CIRCUIT FOR A FLUORESCENT LAMP

[76] Inventor: Yeong-Choon Chung, 933-10, Shinwol 7-Dong, Yangcheon-Ku, Seoul, Rep. of Korea

[21] Appl. No.: 872,243

[22] Filed: Apr. 23, 1992

[51] Int. Cl.[5] ..... H05B 41/29

[52] U.S. Cl. ..... 315/219; 315/DIG. 4; 315/307; 315/224

[58] Field of Search ..... 315/219, 209, 291, 307, 315/119, 127, 224

[56] References Cited

U.S. PATENT DOCUMENTS 4,172,981 10/1979 Smith ..... 315/DIG. 4
4,572,990 2/1986 Leale et al. ..... 315/DIG. 7
5,049,788 9/1991 Lee ..... 315/219
5,051,661 9/1991 Lee ..... 315/225

*Primary Examiner*—Robert J. Pascal
*Assistant Examiner*—Michael B. Shingleton
*Attorney, Agent, or Firm*—Jones, Tullar & Cooper

[57] ABSTRACT

A dimming circuit having a magnetic forced oscillating means incorporating a transformer having three windings, the second winding being connected across a DC power supply and the third winding being coupled to a fluorescent lamp. The second winding is also coupled to an oscillator circuit incorporating a first resistor, a transistor and the first winding. The circuit also includes a variable resistor serially connected to the first resistor, the variable resistor including a movable arm coupled to the first winding for controlling the frequency of operation and thus the brightness of the lamp.

5 Claims, 2 Drawing Sheets

FIG. 1
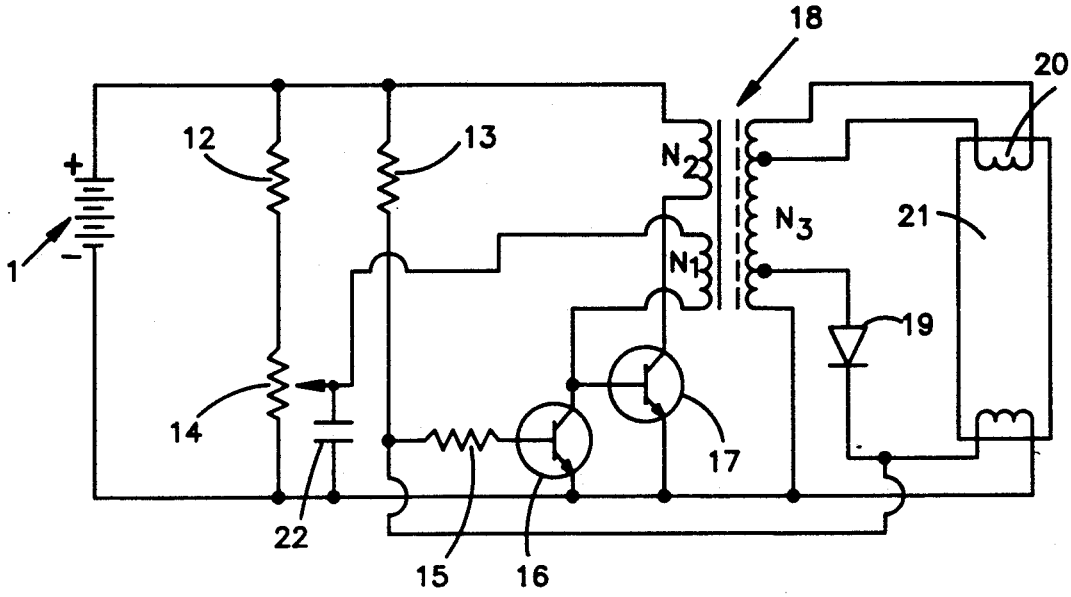
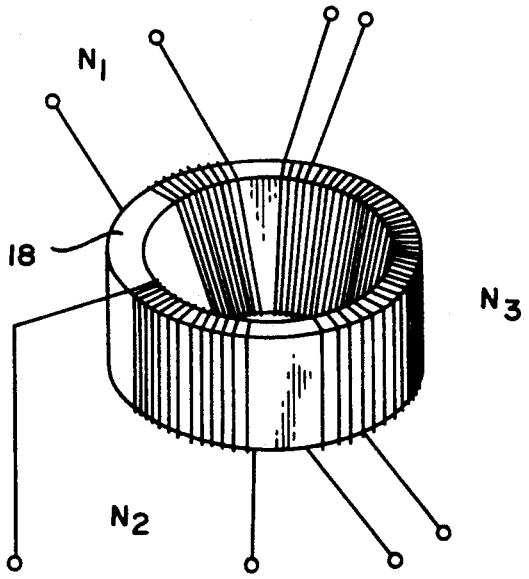
FIG. 2

DIMMING CIRCUIT FOR A FLUORESCENT LAMP

BACKGROUND OF THE INVENTION

The present invention relates to a fluorescent lamp control circuit for operating the lamp from a direct current source and more particularly to a dimming circuit for such a lamp. The invention further relates to a protection circuit for the lamp control which operates when the circuit is in an unloaded condition.

An invertor circuit which utilizes a magnetic force for providing an oscillating source for driving a fluorescent lamp is described in Japanese Utility Model Gazette No. 54-2598, 48-23181. However, in this device it is impossible to control the brightness of the lamp. Furthermore, in the disclosed circuit, there is no emergency mechanism for protecting the circuit against failures in the unloaded condition, where the lamp is not completely connected to the circuit, such as might occur with a bad cutting of a lamp filament, wherein an excess current may cause damage to the dimming circuit or the possible danger of a fire. Despite the importance of restricting excess currents at the unloaded condition, most lamp control circuits previously proposed do not provide a sufficient protection function, and some do not even employ a protection apparatus at all. On the other hand, it is conventional to provide means for controlling the brightness of a lamp, but the circuit architecture for such a controller is very complicated and its control range is not satisfactory, such devices generating a flickering light at low levels of illumination. Furthermore, the manufacturing cost of such prior devices is high, so that such controls have not been feasible in general.

SUMMARY OF THE INVENTION

Accordingly, it is an object of the present invention to provide a dimming circuit capable of controlling the brightness of a fluorescent lamp with ease and convenience and for turning the lamp on, as well, by means of an electronic circuit.

It is another object of the present invention to provide a dimming circuit wherein an excess current at the unloaded condition, such as occurs with a bad contact, can be avoided.

In accordance with the present invention, a dimming circuit is provided which logically detects the state of connection of the fluorescent lamp in the control circuit. If the fluorescent lamp is disconnected from the circuit or has a bad contact with its electrode terminals, or if a filament is broken or otherwise nonfunctional, the circuit current is blocked to protect the circuit. Moreover, in accordance with the invention, the fluorescent lamp can be turned on by a magnetically forced oscillating mechanism, and illumination is optimized by controlling the amount of the current by regulating the oscillation frequency.

BRIEF DESCRIPTION OF THE DRAWINGS

The foregoing, and additional objects, features and advantages of the present invention will become apparent to those of skill in the art from a consideration of the following detailed description of a preferred embodiment thereof, taken in conjunction with the accompanying drawings, in which:

FIG. 1 illustrates a preferred embodiment of the dimming circuit according to the present invention;

FIG. 2 illustrates an oscillating coil and core employed in the dimming circuit of FIG. 1;

DETAILED DESCRIPTION OF THE INVENTION

Figure 3:
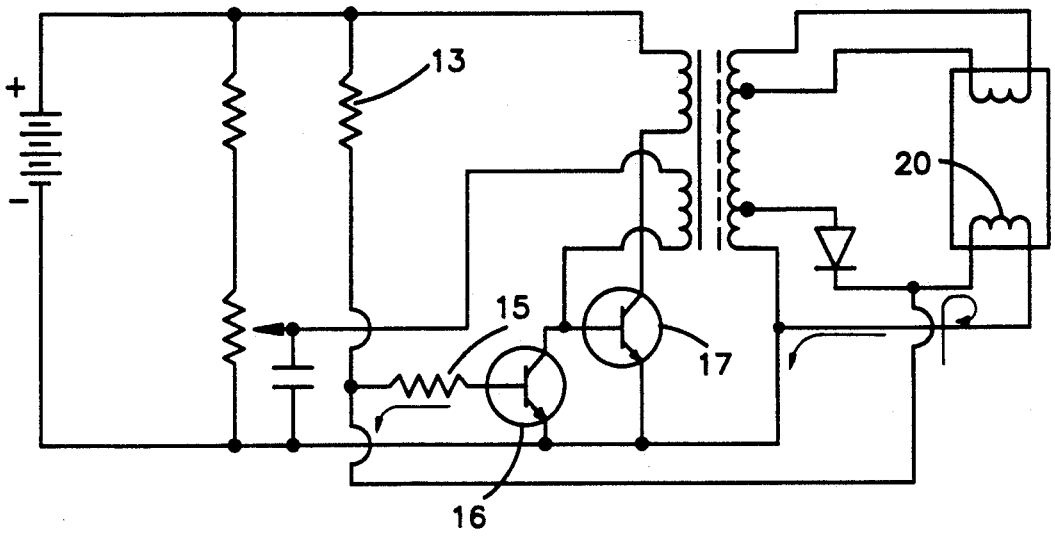
FIG. 3 is a circuit diagram of the dimming circuit of the invention, illustrating current flow when a fluorescent lamp is conducting; that is, when the lamp is operational.

In the following description, it should be noted that the dimming circuit as described relates to an embodiment of the invention for a fluorescent lamp of small power; for example, 40 mW, using a DC power source.

Referring now to FIG. 1, a dimmer circuit according to the present invention incorporates a DC power source such as a battery 1 connected across a voltage divider consisting of series resistances 12 and 14. The positive side of the battery, at the junction between battery 1 and resistor 12 is connected through resistors 13 and 15 to the base of a first transistor 16, the emitter of this transistor being connected to the negative side of battery 1. The collector of transistor 16 is connected through a first winding N1 on a transformer 18 to a tap on resistor 14, the tap also being connected through capacitor 22 to the negative side of battery 1.

The collector of transistor 18 is also connected to the base of a second transistor 17, the emitter of which is connected to the negative side of battery 1 and the collector of which is connected through a second winding N2 on transformer 18 to the junction between the positive side of battery 1 and resistor 12. A third winding N3 on transformer 18 is connected across a fluorescent lamp 21, the filament 20 at one end of the lamp being connected between one end of winding N3 and a tap on N3 and the opposite filament of the lamp being connected to the second end of winding N3 and through a diode 19 to a second tap on winding N3. The junction between the diode 19 and the filament of lamp 21 is connected to the junction of resistors 13 and 15.

With reference to FIG. 1, transistor 17 is turned on or off in accordance with the period of the oscillating frequency which is established by the values of resistors 12 and 14, by the value of capacitor 22, and by the value of the winding N2 on transformer 18. The switching of transistor 17 induces alternating current in the winding N1 of transformer 18 and induces a high voltage in winding N3 to turn on the fluorescent lamp 21.

Magnetically forced oscillators of the type described above are generally known. However, the advanced feature of the present invention includes circuitry for controlling the brightness of the lamp, as will now be described. In accordance with the invention, the switching frequency of transistor 17 is controlled by the movable tap on resistor 14 so that movement of the tap varies the high voltage on the winding N1 of the transformer 18, with the result that the switching frequency can be changed. Thus, a voltage at the secondary coil N3 of transformer 18 is varied in response to the variation in the frequency of the switching current in the primary windings of transformer 18. This change in frequency level varies the amount of tube current within the fluorescent lamp 21, and such a variation results in a change in the brightness of lamp 21. The optimum range of the frequency would be from 7 KHz to 25 KHz, which can achieve a 95% control range of the brightness of the lamp.

As illustrated in FIG. 2, in a preferred form of the invention, the oscillating transformer 18 is in the form of a toroid having an annular core around which the windings of coils N1, N2 and N3 are wound. The size of the toroidal core and the number of turns in each of the windings are determined in accordance with the requirements of the fluorescent lamp to be used.

Figure 4:
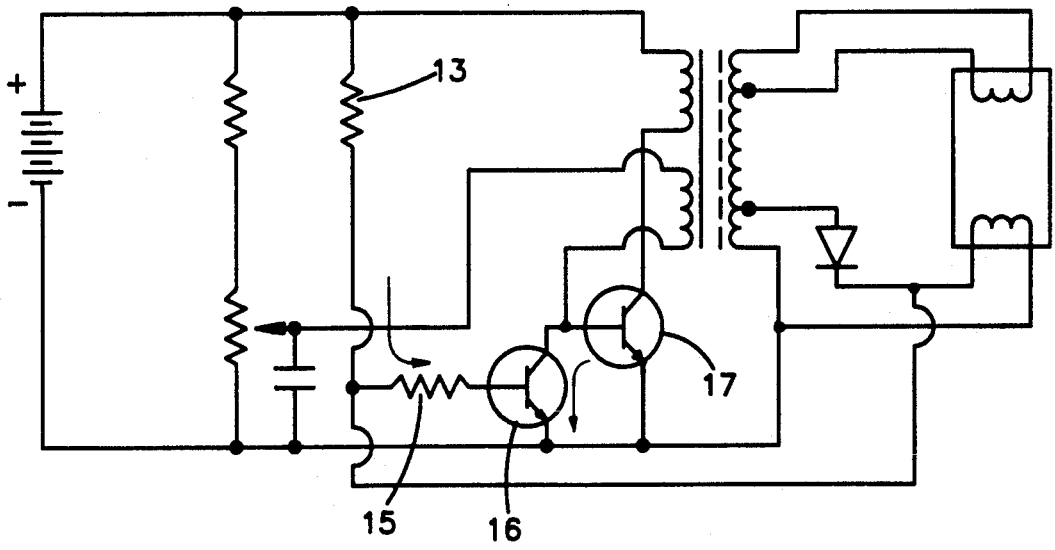
FIG. 4 is a diagram of the current flow in the dimming circuit of the present invention when the lamp is non-conductive.

The protection feature of the present invention, which operates in the unloaded condition, is described with respect to FIGS. 3 and 4, to which reference is now made. In FIG. 3, the arrows show the direction of current flow in the case when the fluorescent lamp 21 is connected to the circuit and is conductive. In this case, the transistor 16 is turned off because of a negative bias which is applied to the base of that transistor through resistor 15 and lamp filament 20. When transistor 16 is turned off, transistor 17 carries out its switching operation in the normal manner and the circuit may be described as being in the loaded condition.

FIG. 4 illustrates the case when the fluorescent lamp is non-conductive, due, for example, to a bad contact. In this case, the circuit is unloaded, but the protective circuit functions to prevent damage. A positive bias current flow loop is formed through resistors 13 and 15, since the current path through the filament 20 is open due to the bad contact. In this case, the transistor 17 is turned off, with the result that the winding N2 of transformer 18 has no current flowing. As a result, no current is induced in winding N3 and the lamp receives no power.

As described above, the present invention provides a dimming circuit having a illumination control function in which the frequency generated from a magnetically forced oscillating circuit is varied to change the current flow in the secondary of a transformer. The variation in this secondary current flow changes the brightness of the lamp. The invention also has a protection function which operates even when a lamp is not conducting, as may occur when there is a bad connection between the control circuit and the lamp. The dimming apparatus according to this invention can be widely used, for example, in an emergency indoor lamp, an indoor lamp for a car, a portable lamp, a lamp in a train, indoor illumination apparatus for a ship, and the like, and may be available for insuring electrical safety and low power consumption.

What is claimed is:

1. A dimming circuit comprising:

magnetic forced oscillator means including a transformer having first, second and third coils;

a first resistor;

a DC power source having a positive line and a negative line and connected across said second coil and across said first resistor;

a fluorescent lamp coupled to said third coil;

a first transistor coupled to said first and second coils;

a variable resistor serially connected to said first resistor, said variable resistor having a variable tap coupled to said first coil for varying the frequency of said oscillator means to control the brightness of said lamp; and protection means comprising:

a base resistor;

a second transistor, said first and second transistors each having base, emitter and collector electrodes;

rectifier means having an anode and a cathode, said anode being coupled to a first output line from said third coil of said transformer and said cathode being coupled through said base resistor to the base of said second transistor;

means coupling the collector of said second transistor to the base of said first transistor;

means coupling the emitter of said second transistor to a negative line of said DC power source;

a second output line from said third coil being coupled to said negative line of said DC power source; and forward-biasing resistor means coupling said base resistor to said positive line of said DC power source to protect said dimming circuit from destruction due to excess current.

2. The dimming circuit of claim 1, wherein said transformer includes an annular core and wherein said first, second and third coils are toroids wound on said core.

3. A dimming circuit comprising:

magnetic forced oscillator means including a transformer having first, second and third coils;

a first resistor;

a variable resistor serially connected to said first resistor, said variable resistor having a variable tap coupled to said first coil for varying the frequency of said oscillator means;

a DC power source having a positive line and a negative line and connected across said second coil and across said first resistor and said variable resistor;

a capacitor connected between said variable tap of said variable resistor and said negative line of said DC power source;

a first transistor having a base, an emitter and a collector, said base being coupled through said first coil to said variable tap of said variable resistor, and said collector and emitter being connected between said second coil and said negative line; and, a fluorescent lamp coupled to said third coil;

whereby, adjustment of said variable resistor changes the switching frequency of said first transistor and thus the frequency of said magnetic forced oscillator means, thereby varying the brightness of said fluorescent lamp.

4. The dimming circuit of claim 3, wherein said transformer includes an annular core and wherein said first, second and third coils are toroids wound on said core.

5. The dimming circuit of claim 3, further including protection means comprising:

a base resistor;

a second transistor having base, emitter and collector electrodes;

rectifier means having an anode and a cathode, said anode being coupled to a first output line from said third coil of said transformer and said cathode being coupled through said base resistor to the base of said second transistor;

means coupling the collector of said second transistor to the base of said first transistor;

means coupling the emitter of said second transistor to a negative line of said DC power source;

a second output line from said third coil being coupled to said negative line of said DC power source; and forward-biasing resistor means coupling said base resistor to said positive line to said DC power source to protect said dimming circuit from destruction due to excess current.

* * * * *